US005721385A

United States Patent [19]

Charmer

[11] Patent Number: 5,721,385

[45] Date of Patent: Feb. 24, 1998

[54] TESTING DEVICE FOR GAS PILOT LIGHT

[75] Inventor: Robert Charmer, Chorley, United Kingdom

[73] Assignee: Robinson Willey Limited, Liverpool, United Kingdom

[21] Appl. No.: 717,812

[22] Filed: Sep. 24, 1996

[51] Int. Cl.[6] ..... F23N 5/02

[52] U.S. Cl. ..... 73/865.6; 431/13

[58] Field of Search ..... 73/865.9, 865.6; 431/13–15

[56] References Cited

U.S. PATENT DOCUMENTS 3,896,422 7/1975 Kowalsky .

FOREIGN PATENT DOCUMENTS 245700 1/1926 United Kingdom ..... 431/13

2185609 7/1987 United Kingdom .

2204156 11/1988 United Kingdom .

*Primary Examiner*—Robert Raevis

*Attorney, Agent, or Firm*—Collard & Roe, P.C.

[57] ABSTRACT

A portable device for testing the performance of an oxygen-depletion-sensing pilot light jet comprising a gas mixture applicator means, a pressurizable vessel forming a reservoir for containing a gas mixture which has an oxygen content just below the level at which the oxygen-depletion-sensing pilot light should safely operate a gas mixture flow control means or valve means controlling flow of said gas mixture to said applicator means; said gas mixture applicator means being connected to the reservoir by ducting for receiving said gas mixture from the reservoir and to enable supply of said gas mixture as a localized ambient environment to the pilot jet and light.

31 Claims, 9 Drawing Sheets

TESTING DEVICE FOR GAS PILOT LIGHT

The present invention relates to a testing device for a gas pilot light and more particularly to a portable device for testing the performance of an oxygen-depletion cut-out system of a gas fire or other gas appliance.

It is important from a safety point of view to ensure that a gas fire or other gas appliance does not continue to burn when the level of oxygen in a room falls below a safe-level for example, as a result of carbon monoxide/dioxide being returned to the room because of a blocked flue. An oxygen-depletion sensing (ODS) pilot jet has been designed such that the pilot light jet has two flames—one directed to the region of the main gas burner and the other directed to a thermocouple. Oxygen is supplied to said flames via an air inlet aperture in the pilot gas supply line and the pilot light device and the air inlet aperture are designed such that in normal conditions, the pilot flames are stable but such that should the oxygen level being supplied to the air inlet aperture drop below the requisite level, the flame becomes unstable and the flame acting on the thermocouple ceases to act on such with the result that the main gas valve supplying the gas fire or like installation shuts off the gas supply to the main burner. Such oxygen-depletion sensing pilot lights (ODS pilot lights) are known and comprise an important safety device and it is a testing device for such with which the present invention is concerned.

In most existing gas fires, normally the gas supply pipe to the pilot jet, which is normally of thin copper tube which is somewhat flexible/pliable, is only of a length necessary to connect the jet to the gas supply and does not permit sufficient safe movement of the pilot jet and (possibly the attached mounting bracket possibly with thermocouple and spark ignition electrodes) to enable a sufficient displacement of the jet to allow easy mounting of a gas mixture applicator housing therearound and subsequent remounting of the jet without damaging the integrity of the gas joints—without "breaking the gas connections".

With the increasing requirements for safety monitoring in respect of gas appliances, the present invention is concerned with providing a method and apparatus for testing or assessing the performance of an oxygen depletion pilot light to ensure that it is still functioning correctly after the device has been in use some time.

According to the present invention there is provided a portable device for testing the performance of an oxygen-depletion-sensing pilot light jet comprising a gas mixture applicator means, a pressurisable vessel forming a reservoir for containing a gas mixture which has an oxygen content just below the level at which the oxygen-depletion-sensing pilot light should safely operate a gas mixture flow control means or valve means controlling flow of said gas mixture to said applicator means; said gas mixture applicator means being connected to the reservoir by ducting for receiving said gas mixture from the reservoir and to enable supply of said gas mixture as a localised ambient environment to the pilot jet and light.

Preferably wherein said applicator means is selected from the group comprising:

in a first arrangement applicator means permitting said gas mixture to flow from said flow control means to atmosphere at ambient pressure and said applicator means including a supply duct locatable adjacent and/or over at least the air inlet aperture of an oxygen-depletion-sensing pilot light jet to supply said gas mixture thereto at ambient atmospheric pressure;

in a second arrangement said applicator means comprising a housing locatable to surround an oxygen-depletion-sensing pilot light jet and the air inlet aperture therefor to enable supply said gas mixture to the air inlet aperture and to provide said gas mixture as a localised ambient environment to the pilot light; and in a third arrangement said applicator means comprising a gas mixture supply duct or pipe extending into at least one apertured supply duct portion shaped and arranged and apertured to provide a gas mixture environment surrounding said pilot light.

Preferably in the first arrangement the free end of the supply duct will be so shaped as to be closely locatable against the surface surrounding the air inlet aperture of the pilot light and may possibly have sealing means which may be provided in different replaceable forms as an adaptor to different surfaces. Attachment means may also be provided for releasably holding said supply duct over said air inlet aperture. The applicator means preferably has a main duct or chimney-like member for venting the gas mixture to atmosphere. The applicator means is preferably in the form of a main tubular member with a normally lowermost inlet aperture in communication via the gas mixture flow control means (valve) of the gas mixture reservoir and having said supply duct extending therefrom and preferably at right angles and preferably from a normally lower region adjacent but spaced from the valve to enable supply at atmospheric pressure. It is important that the gas mixture of the testing device should not be applied to the air inlet aperture of the pilot light jet at other than ambient atmospheric pressure or substantially ambient pressure since an inaccurate test might otherwise result.

In the alternative second arrangement of the applicator means according to the invention such comprises a housing which encloses the whole of the ODS pilot light including the air inlet therefor to provide an ambient atmosphere of said gas mixture for the whole of the pilot light and its flame and preferably the ignition device although an opening may be provided in the housing to permit the pilot light to ignite the adjacent burner in normal manner although preferably the supply to the burner is closed so that only the pilot light is lit. At least one wall portion of the housing will preferably be removable to permit location of the housing over the pilot jet. It is expected that for each range of fire, an especially shaped housing will have to be provided and contoured such as to enable the housing to locate on and around the pilot and its ignition device and such as to prevent or minimize any inflow of ambient air.

Also according to the present invention a method of testing the performance of an oxygen depletion sensing pilot light jet of a gas fire or other gas appliance in situ, comprises applying an oxygen depleted gas mixture to at least the air inlet of said pilot jet and when the pilot light is lit, and determining whether the pilot flame ceases to act upon the thermocouple of the appliance so as to cut off the main gas supply.

Preferably in the second arrangement at least, the housing will be located around at least the pilot jet with the inlet in the housing for the gas mixture initially being open to atmosphere so that the pilot flame becomes stable once the adjacent metals become heated. The reservoir containing the depleted oxygen gas mixture is then connected to the inlet or communicates therewith such that said gas mixture enters the housing either by being drawn in by the flame burning and/or by being under slight pressure.

According to a second aspect of the present invention an improved gas fire or other gas appliance including an ODS pilot light jet and being adapted to be tested with a portable testing device also according to the invention or other testing device, includes a gas supply pipe leading to said jet, characterised by the feature that displacement enabling means are provided to enable at least said jet and possibly also its mounting support with thermocouple and ignition means, once detached from its mounting on the appliance, to be displaced sufficiently to enable a gas mixture applicator housing to be located therearound.

The displacement enabling means may comprise a displaceable joint in the supply pipe such as a pivoting or universal joint or a more flexible portion thereof or supply pipe extension means.

Where it is desired not to "break" the gas connection, the displacement enabling means are extension means which may comprise in one embodiment making said supply pipe longer than simply required to supply gas to said pilot jet and may take the form of at least one loop or "pig tail" which enables supply pipe to be flexed and at least the pilot jet to be displaced sufficiently away from its mounting point on the appliance to permit the applicator housing to be located therearound. The "pig tail" in the thin, jet supply pipe enables the pipe to be sufficiently flexed without damaging the integrity of the gas tight joints of the pipe.

Alternatively and where "breaking" of the gas connection is possible, the extension means may be an extra length of tube, preferably flexible tubing, and the jet may be detached from its supply pipe and the extra length of tube connectable, by connection means if required, to the supply pipe and to the jet. The extra length of tube will be such, e.g. of diameter and/or length, as to maintain the requisite pressure for an accurate and representative test of the jet. An adaptor or connecting device for between the now free end of the supply pipe and the tube and/or for between the tube and the pilot jet may be provided.

If complete removal of the jet is envisaged, the applicator housing will be capable of free standing and the housing shape and/or construction may differ from that necessary when the housing is to be mounted around a jet etc., in situ on a gas appliance, e.g. a mounting means for the jet will be provided in the housing and an upper part of the housing may be removable to permit location and removal of the jet—possibly together with the support carrying the thermocouple and spark ignition means.

An exhaust duct will normally be provided in an upper region and normally the gas supply will be that of the appliance although a separate gas supply may be provided and preferably pressure regulatable to meet the test requirements.

In an alternative inventive concept, a portable device for testing an ODS pilot light jet comprises a portable housing in which a jet is locatable either dismounted from the gas appliance with extension means supplying gas from the appliance or having a separate gas supply connection or detached from the main body of the appliance whilst retaining its gas supply connection therewith—possibly via extension means such as at least one supply pipe loop, or in situ on the appliance, with said portable housing being closable or sealable at least around the extension means or gas supply pipe so as to then provide a closed and sealed space in which the pilot jet may burn and be extinguishable by the combustion products of the flame. A base or bottom plate may be provided formed in two parts or more, which may be pivoted, and which are displaceable together under the pilot jet and any other associated item (thermocouple and ignition device) to close around any supply pipe and wire or tube and preferably has flexible/resilient sealing means to close therearound. A suitable flame viewing means or flame detecting means is provided so that the time of extinction of the flame after closing the housing can be measured to determine the operating condition of the ODS jet. Timing means will be provided either on the housing and preferably operating on sealing or separately. Where the flame viewing means is a window, suitable anti-misting means may be provided or it formed of mica. In its simplest form, the embodiment might comprise a support plate and means for closing around the supply pipe to at least the jet and a bell-jar.

In a further development of the alternative arrangement of the present invention, where a portable box-like housing is provided to contain at least the pilot jet, and where the pilot jet is to be removed from the appliance, such as proposed herein, the housing will have a mounting bracket or other means for the jet or a connection means for the mounting bracket of the appliance and jet, preferably with the thermocouple and spark ignition means, and a back wall or plate of the housing, preferably with slot for replicating the burner ignition slot, preferably presenting the same back plate and ignition slot relationship as exists on the appliance from which the jet has been detached.

In a further development of the invention, a cover means or hood for covering the front of a gas fire is provided preferably with an inspection window or viewing gap together with a gas mixture reservoir and flow control means, with the cover being shaped to ensure when mixture flows the ODS pilot jet is in an ambient gas mixture atmosphere to test the jet. Normally the burner unit will be turned off.

The invention will be described further, by way of example, with reference to the accompanying drawings, in which.

Figure 1:
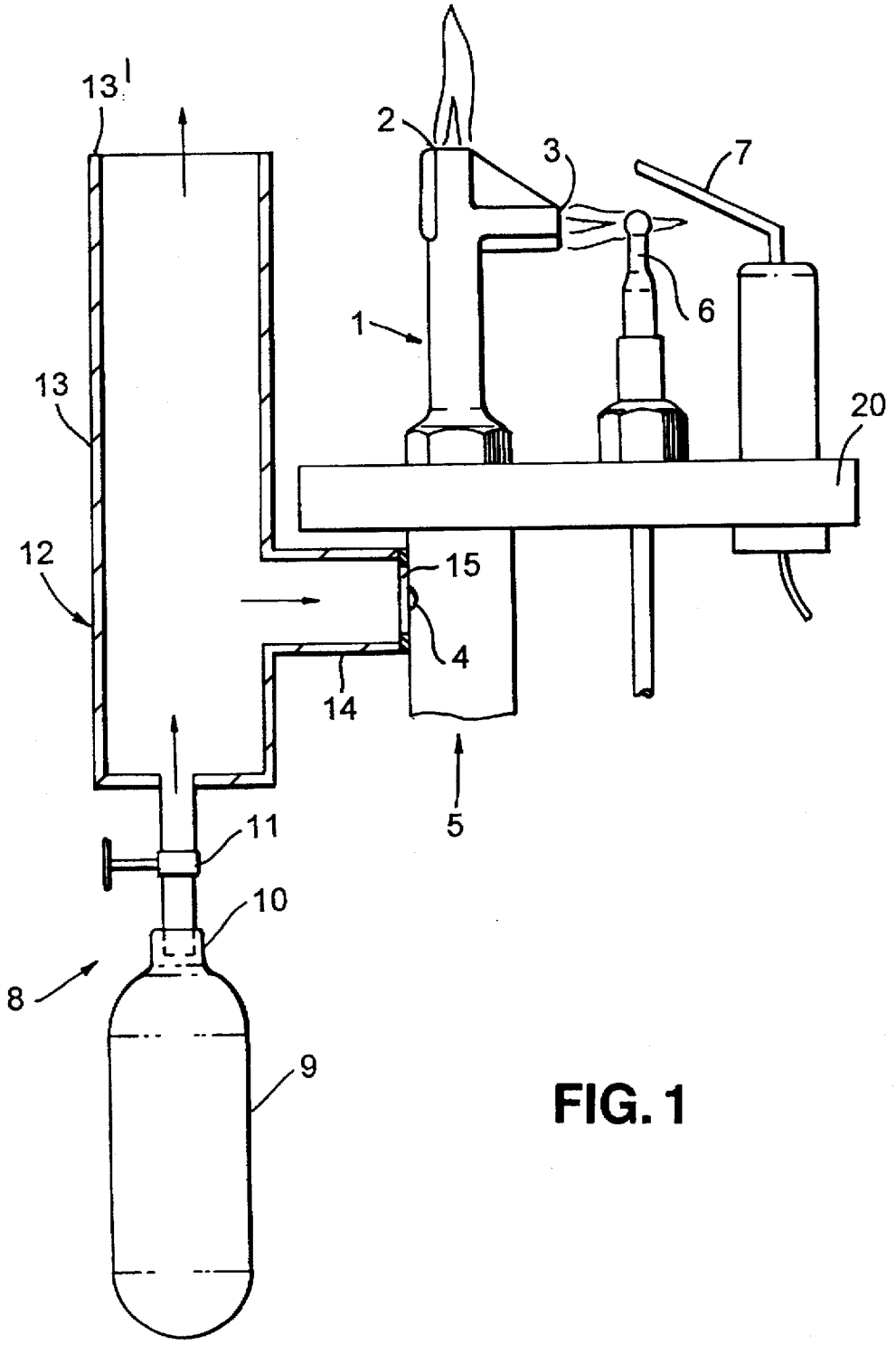
FIG. 1 is a schematic part section part elevation of a portable testing device forming one embodiment of the first arrangement of the invention illustrated located in position against an oxygen depletion sensing pilot jet.

A testing device according to the present invention is intended for use with an oxygen depletion sensing gas pilot nozzle or jet 1 (such as sold under the trade mark "SIT") which in use has a gas outlet duct and flame 2 directed to the main gas burners (not shown) of the gas fire (not shown) and a thermocouple, gas outlet duct and flame 3 directed to play the flame against a thermocouple 6 with said pilot light being ignitable by a piezo-electric device 7 in known manner. The gas is supplied to the pilot jet 1 via duct 5 and an air inlet aperture 4 is provided in the pilot light jet 1 which jet is designed in known manner such that under normal conditions of operation with the requisite amount of oxygen, the flames from apertures 2 and 3 are just on the limit of stability and such that when the level of oxygen entering through aperture 4 drops below the safe level, flame 3 becomes unstable and ceases to burn and play against thermocouple 6 with the result that the thermocouple acts via an electromagnetic valve (not shown) to cut off the gas supply to the fire in known manner.

A testing device 8 according to the present invention comprises a pressurized or pressurisable gas bottle 9 forming a reservoir for a gas mixture which has an oxygen content at least just below the level of oxygen required for safe operation of the gas fire. The gas bottle 9 is secured by threaded means 10 to a duct leading via a valve 11 to an applicator means 12. The applicator means 12 comprises a main chimney or tubular body 13 with its normally upper end 13' open to atmosphere and with the tubular body 13 being of a sufficiently large size as to enable gas exiting from the reservoir bottle 9 to be at ambient atmospheric pressure. An applicator or supply duct 14 extends laterally of the main duct 13 and is locatable over the air inlet aperture 4 of the pilot jet 1 and the whole device is designed such that the test gas flowing from bottle 9 is at atmospheric or substantially atmospheric pressure as it enters the air inlet aperture 4 so as to give a proper test result.

In this respect, the pressure of gas being permitted to flow through valve 11 and the dimensioning of the main duct means 13 and supply duct 14 should be dimensioned to enable gas mixture at or substantially at atmospheric pressure to be applied to the aperture 4. Suitable sealing means 15 such as in the form of an annular resilient ring may be provided at the edge of the free end of supply duct 14 to ensure proper sealing against the surfaces surrounding inlet aperture 4. The end of duct 14 may be appropriately shaped to fit against said surrounding surfaces.

It is even envisaged that the free end of duct 14 may have different seating pieces securable thereon as adaptors to different feed pipes for different pilot jets depending on the fire being tested and to ensure a proper sealing/seating. Additionally, releasable securement means, such as a clip, may be provided for releasably securing the supply duct 14 in position over the aperture 4. Instead of a supply duct 14, an open collar or other open channel means may be provided to surround or partially surround the pilot jet feed pipe in the region of inlet aperture 4 to provide said mixture thereto.

In practice, the pilot flame will be first lit and allowed to become stable by the heating up of adjacent surfaces before the gas mixture is allowed to be drawn in.

Figure 2:
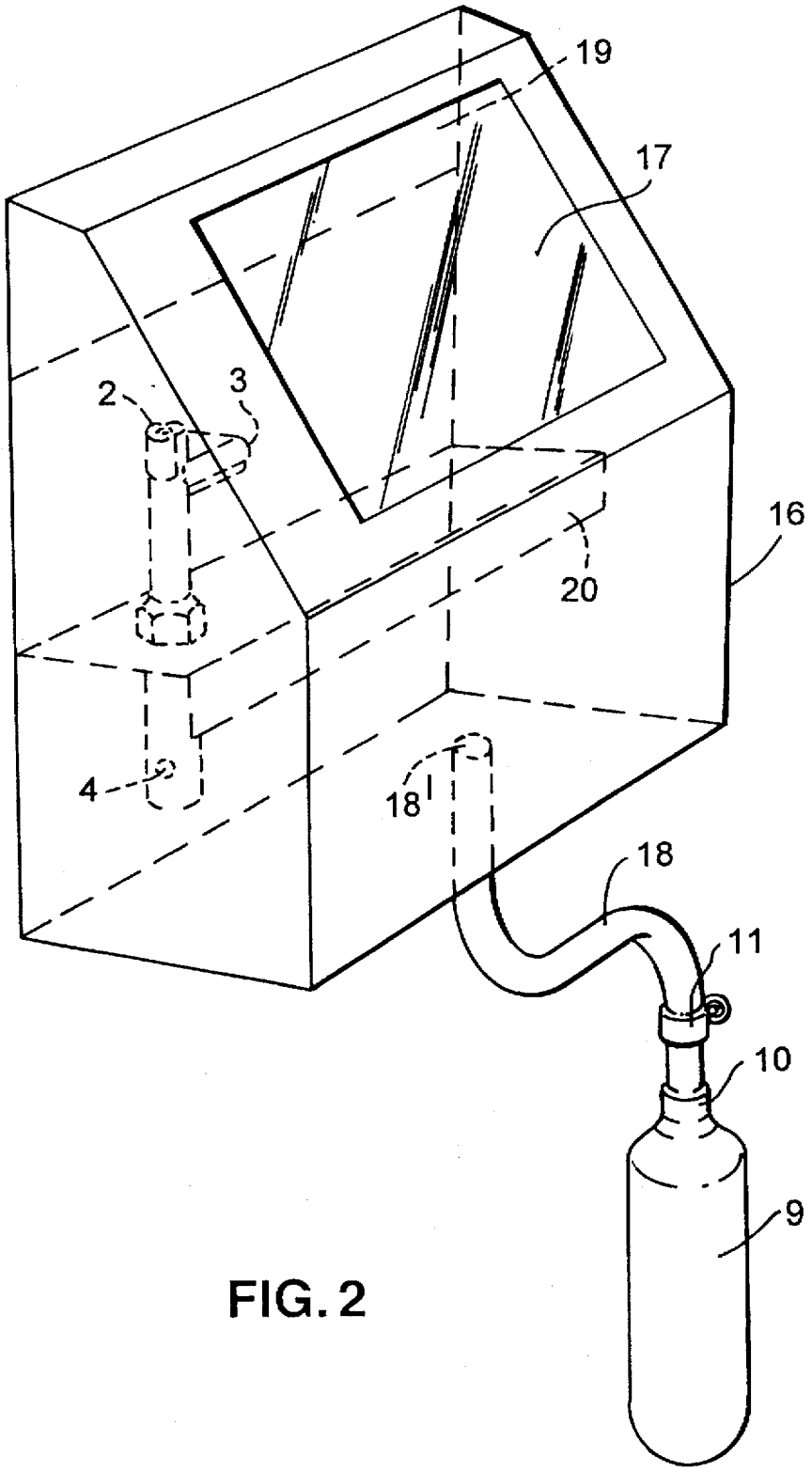
FIG. 2 is a schematic perspective view of a further portable testing device forming a second embodiment of the second arrangement of the invention.

In the embodiment of FIG. 2, a portable box-like housing 16 is provided having a transparent viewing window 17 of suitable heat resistant glass to enable the pilot jets 2 and 3 to be viewed. In FIG. 2, the electrode 7 of the piezo-electric device and the thermocouple 6 have been omitted for the sake of clarity but such will be encompassed within the housing.

The reservoir 9 for said oxygen depleted gas mixture which contains oxygen just below the level at which the oxygen-depletion-sensing pilot light should operate, is connected via pipe 18 and an inlet aperture 18' in the housing base to the interior of the housing 16. Control valve 11 is also provided to control the gas mixture flow.

An outlet aperture 19 is provided in the rear of the housing 16 (or the top) to vent the gas mixture from reservoir 9 to atmosphere at atmospheric pressure. It will be appreciated that the housing 16 also surrounds the air inlet 4. By providing the housing to surround all the ignition and nozzle and flame area a more accurate representation of oxygen depletion is created for the test purposes.

It will be appreciated that because the pilot jet 1, thermocouple 6 and ignition electrode 7 are mounted on a support bracket 20 which is detachably mounted on the gas fire in a position to enable the flame from nozzle 2 to ignite the gas burner (not shown), it will be necessary to construct the housing 16 in parts (not shown) to permit mounting in the requisite surrounding manner. For example, the housing 16 may have a removable or separable bottom panel. Alternatively, and preferably the lower half of the back panel of housing may be detachably removable to permit location of housing 16 and then be mounted in part or completely to close the bottom part. If need be the support bracket for the pilot jet may be loosened or removed to permit location. It is even envisaged that each gas fire may be constructed to include a side wall part and preferably releasable retaining means for the housing 16 to facilitate the mounting and testing operation.

Figure 3:
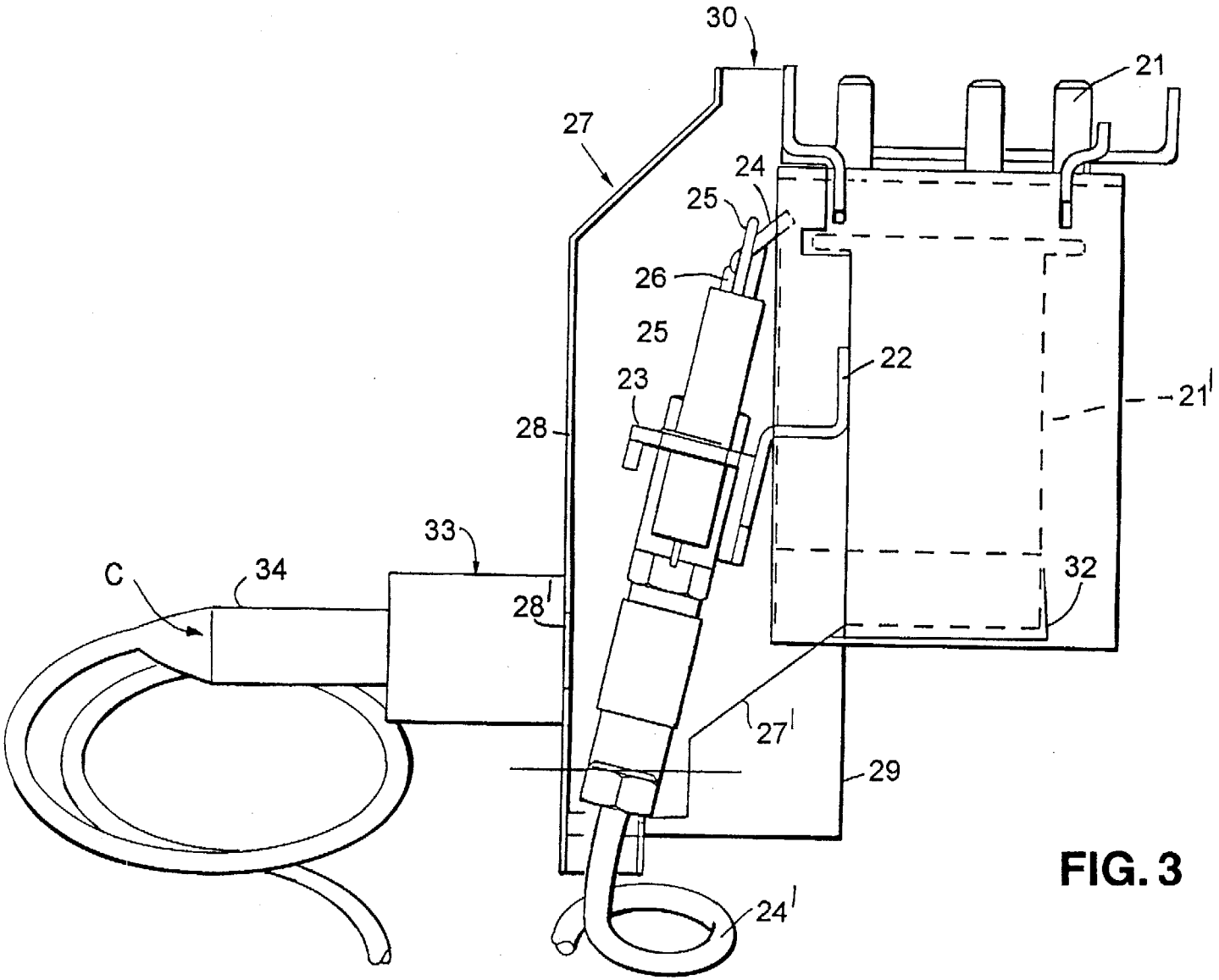
FIG. 3 is a schematic cross-sectional elevation of a part of a gas fire appliance showing the burner unit having a front mounting bracket with inclined lowermost limb carrying a support bracket for an ODS pilot jet, a thermocouple and an ignition device and which later are within an applicator housing secured to the gas fire.
Figure 4:
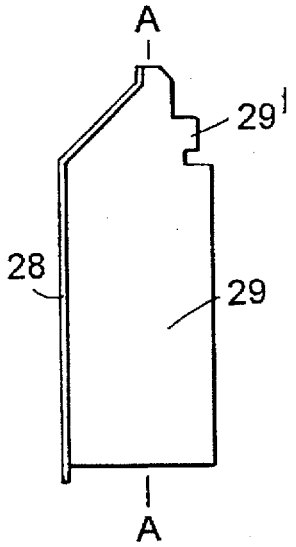
FIG. 4 is a section through the side walls and top of the applicator housing on its own without front gas inlet manifold and without the housing bottom and clamping bracket.
Figure 4A:
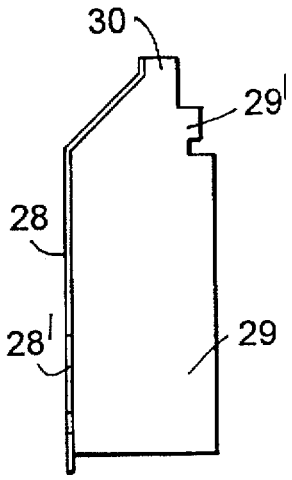
FIG. 4A is an elevation of the housing of FIG. 4.
Figure 5:
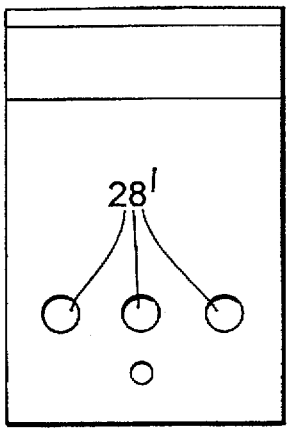
FIG. 5 is a schematic front elevation of the housing showing the apertures.
Figure 5A:
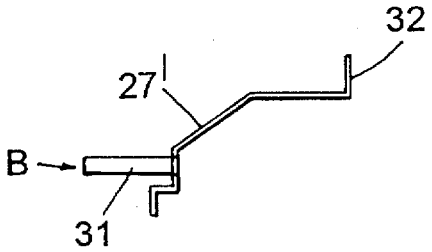
FIG. 5A is a side elevation of a clamping mounting bracket.
Figure 6:
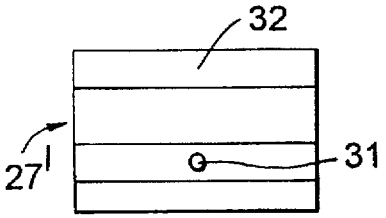
FIG. 6 is a front elevation of the clamping and mounting bracket of FIG. 5A viewed in the direction of arrow B.

In FIG. 3 part of a gas fire is schematically illustrated comprising a gas burner unit 21 having an angled mounting bracket 22 fixed thereto and on which is detachably mounted a support plate 23 for an ODS pilot jet 24, a spark ignition electrode 25 and a thermocouple 26. The gas supply pipe for jet 24 will preferably have extension means such as at least one loop or "pig tail" 24' to enable the jet 24 to be displaced from bracket 22 without jeopardising the gas joints (not shown) of the supply pipe. The connections to the ignition device 25 and the thermocouple are sufficiently flexible and not shown.

In FIG. 3 an applicator housing 27 has been located over the jet 24, ignition device 25 and thermocouple 26 and clamped to the front of the supply manifold 21' to burner unit 21. The housing 27 comprises a front wall 8 with two side walls 29 which fit contouredly against the burner unit and adjacent parts so that the otherwise open rear wall of the housing 27 is formed by the adjacent parts of the gas fire. An exhaust opening 30 is provided at the top and also enables the flames of the jet to be viewed. The shaped edges 29' ensure a snug closure against the fire parts. The housing and apertures and gas mixture flow are designed to ensure a suitable ambient atmosphere for the pilot jet for accurate testing.

The bottom of the housing 27 is formed by a shaped plate 27' which locates with close fit between side walls 29 and has a tubular part 31 acting as a spacing means and seal around a securing nut and bolt (not shown). The rear part 32 of plate 27' clamps by tightening the nut and bolt against the rear of the supply manifold 21' to the burner unit to hold the housing 27,27'.

A box-like inlet manifold 33 with inlet pipe 34 is provided on the front wall 28 and enables a depleted oxygen gas mixture to be supplied via control means (not shown) from a reservoir means (not shown) such as a pressurised cylinder. The manifold 33 overlies three apertures 28' in wall 28 to reduce the gas velocity so as to provide an accurate test. The openings and flow are such that the pilot flame is not effected with fresh air.

Figure 7:
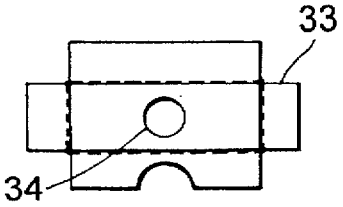
FIG. 7 is an elevation in direction of arrow C of the gas inlet manifold box and inlet pipe.
Figure 8:
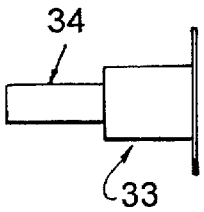
FIG. 8 is an elevation of the box of FIG. 7.

In FIG. 7, the semi-circular cut-out is to enable the unit to rest on the supply pipe. It will be appreciated that the ODS pilot jet flame can be tested in situ with the application means of FIGS. 2 to 8.

Figure 9:
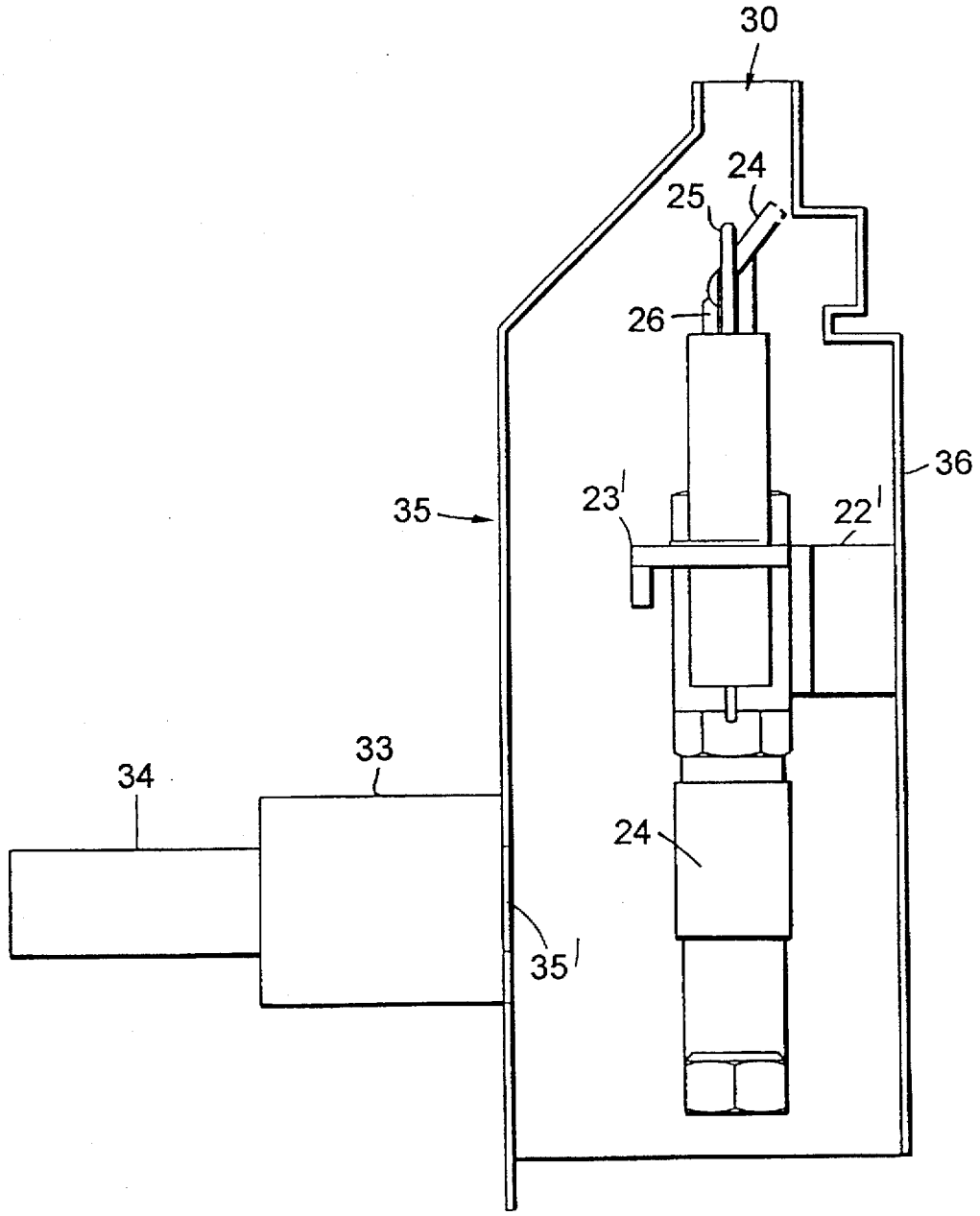
FIG. 9 is a schematic elevational cross section of an alternative embodiment of the applicator wherein support plate of the jet and thermocouple and ignition device has been detached from the body of the gas fire and mounted in an applicator housing.
Figure 10:
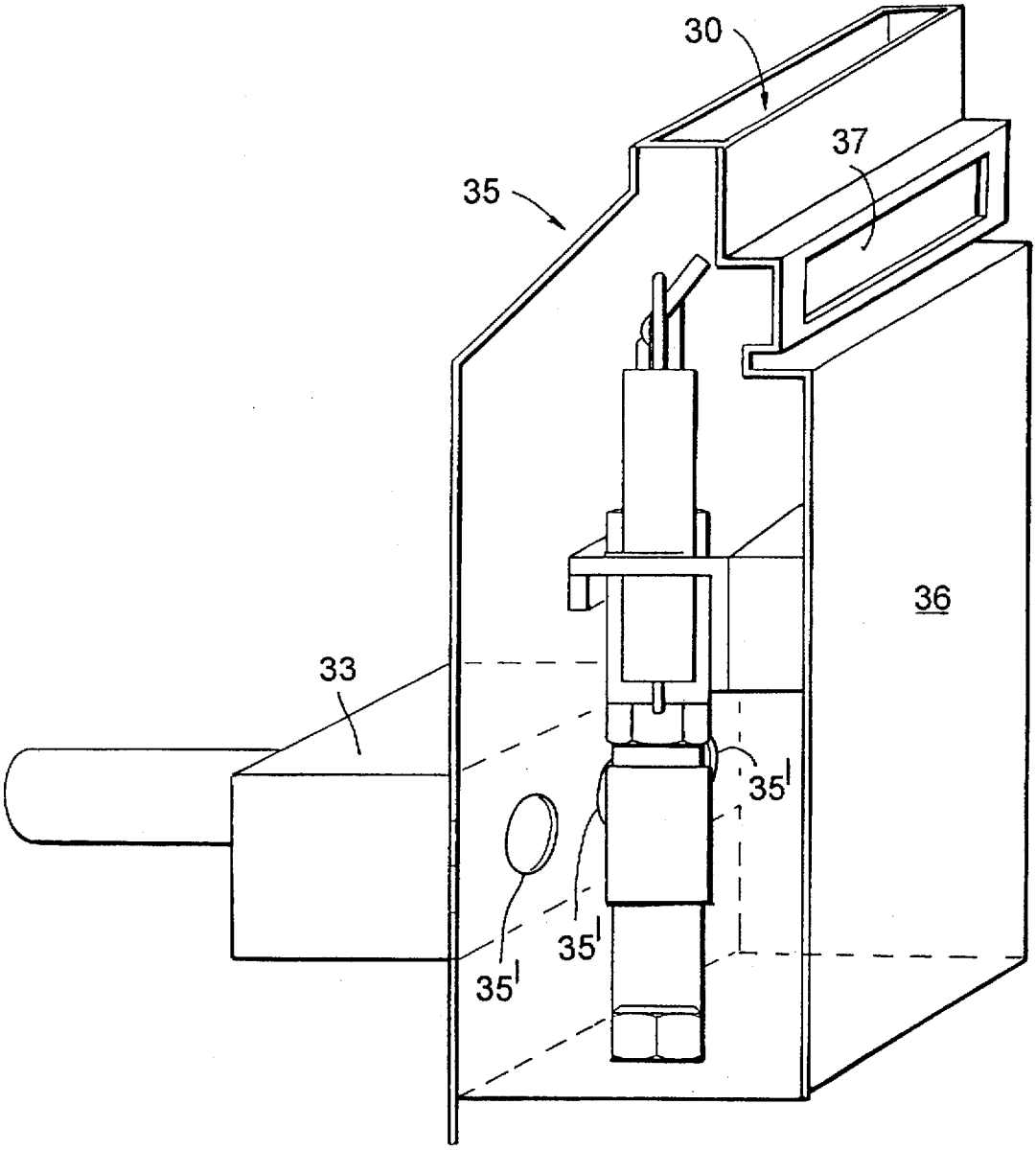
FIG. 10 is a modification of FIG. 9 illustrating such in perspective manner and particularly the vent slot in the upper part of the back wall.

The applicator means of FIGS. 9 and 10 is similar to that of FIGS. 2 to 8 except it is modified so as to enable the pilot jet 24, ignition means 25, thermocouple 26, and support plate 23' to be detached from bracket 22 and (via such extension means) displaced to be mountable within housing 35 which has a mounting bracket 22' for plate 23' and a more or less continuous rear wall 36 but with slot 37 corresponding to the slot to the burner unit for the pilot flame of the gas fire. It is important that the contour rear wall 36 and the spacial mounting for the jet 24 etc., replicate the conditions of the gas fire from which they have been displaced from to provide an accurate test.

The housing 35 can be free standing and be provided in two separable but interconnectable parts.

Figure 11:
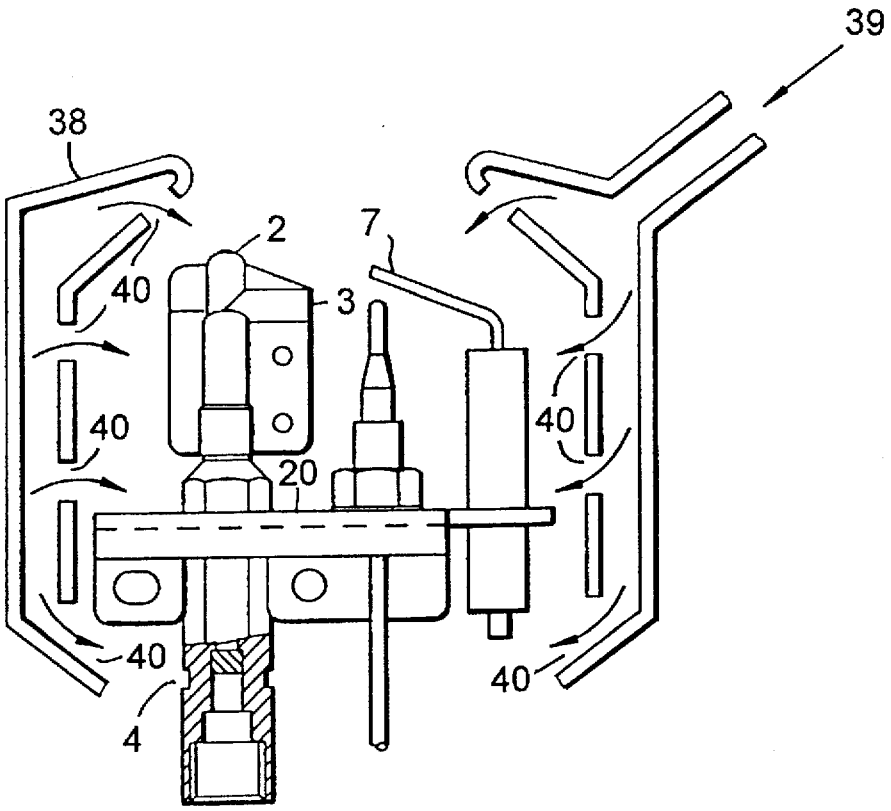
FIG. 11 is a part front elevation of pilot jet thermocouple and spark ignition device of a gas appliance with a gas mixture applicator means in the form of a front cover schematically shown in section.
Figure 12:
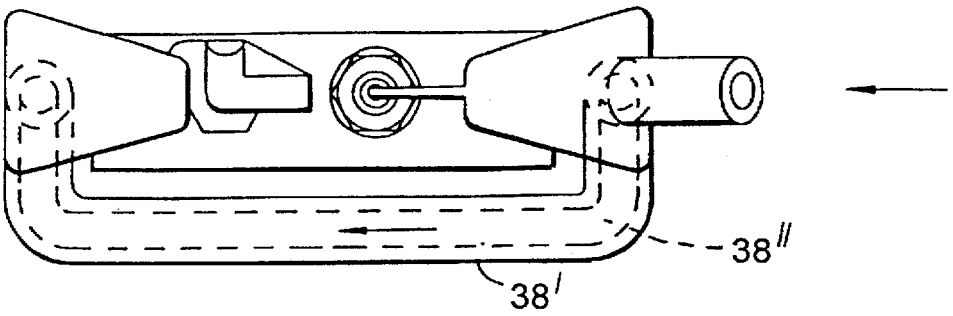
FIG. 12 is a plan view of the front cover of FIG. 11.

In FIGS. 11 and 12 a double-walled housing or front cover means or hood 38 forming a gas mixture applicator means is schematically illustrated in section and plan and is of generally concave or cup-like shape locatable around the front of the pilot jet etc. The front cover 38' has hollow walls or ducts 38" therein through which the oxygen depleted gas mixture is passed and inlet 39 connected to a gas mixture reservoir and control valve (not shown) but similar to that illustrated previously. Gas mixture is directed through apertures 40 in the inner wall of the housing 38 to the pilot flame.

Figure 13:
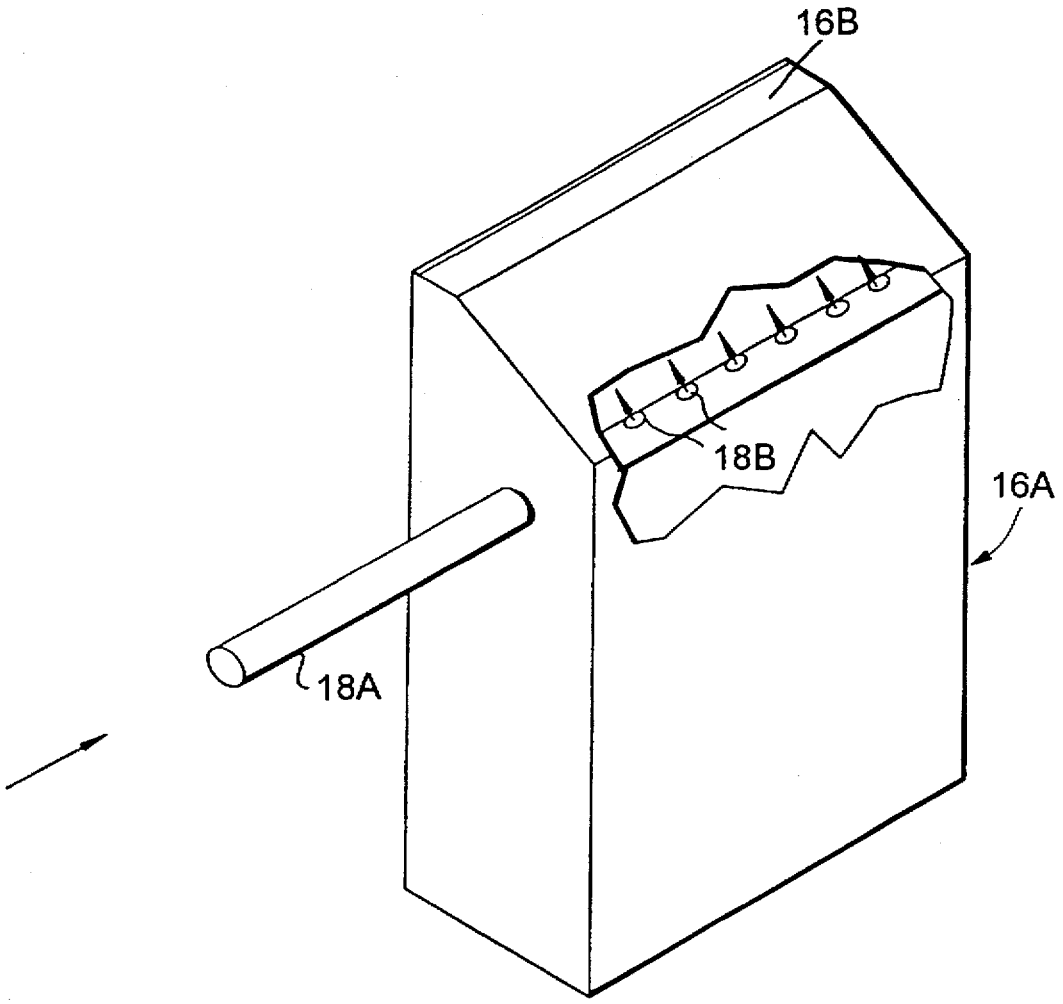
FIG. 13 is a schematic illustration of a further alternative embodiment with an apertured pipe directing the gas mixture in the region of the pilot jet and flame.

In FIG. 13, a housing 16A similar to that of FIG. 2 is illustrated but not showing a viewing window and having an upper opening 16B and with the back open to enable insertion over at least the ODS pilot jet. Oxygen-depleted-gas mixture is fed from a pressurised reservoir vessel controlled by a valve (neither shown) via a pipe 18A which extends into the housing 16A in an upper region to discharge the mixture via apertures 18B closer to the pilot jet when therein and so as to economise on mixture. Whilst apertures 18B are indicated extending upwardly and rearwardly they will preferably be located to direct gas mixture rearwardly and downwardly at 45° to the horizontal.

In the gas mixture utilising-embodiments, the flow of oxygen depleted gas mixture into the housing and the size of the outlet aperture or apertures are such that during testing the interior of the housing is filled with a mixture which provides an accurate simulation of oxygen depletion and test for the pilot jet or jets.

Figure 14:
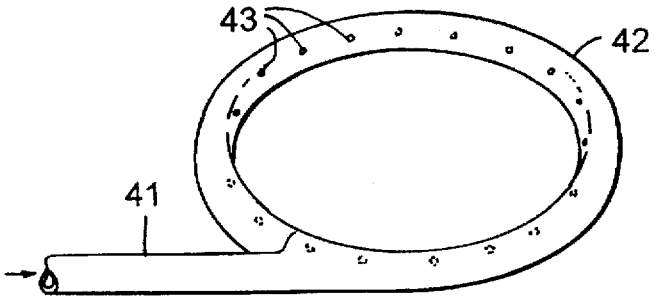
FIGS. 14–16 are schematic views of alternative embodiments of applicator means provided simply as apertured ducting means to discharge gas mixture so as to surround the regions of the pilot flame which enable maintenance of ignition.

In plan view FIG. 14 a depleted oxygen gas mixture is contained in a pressurisable reservoir vessel (not shown) and led via a control valve to a ducting means or pipe 41 which has a continuous loop 42 which has a plurality of apertures 43 arranged and disposed so as when this loop is located over the pilot light jet, the gas mixture is directed to envelope the flame to test the ODS pilot jet. The gas appliance in which the ODS pilot jet is being tested, will preferably have means for locating the loop 42 in a test position.

Figure 15:
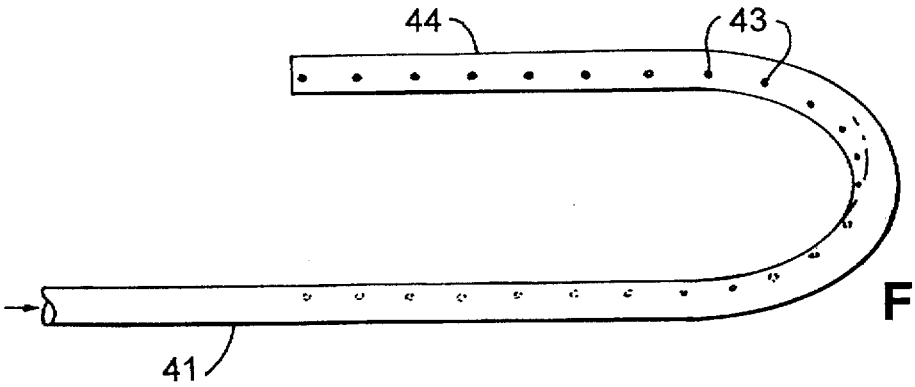

In FIG. 15 a variation of the embodiment at FIG. 14 is illustrated in plan where instead of an apertured loop, a U-shaped apertured portion 44 is provided having apertures 43 to direct gas to envelope the pilot flame.

Figure 16:
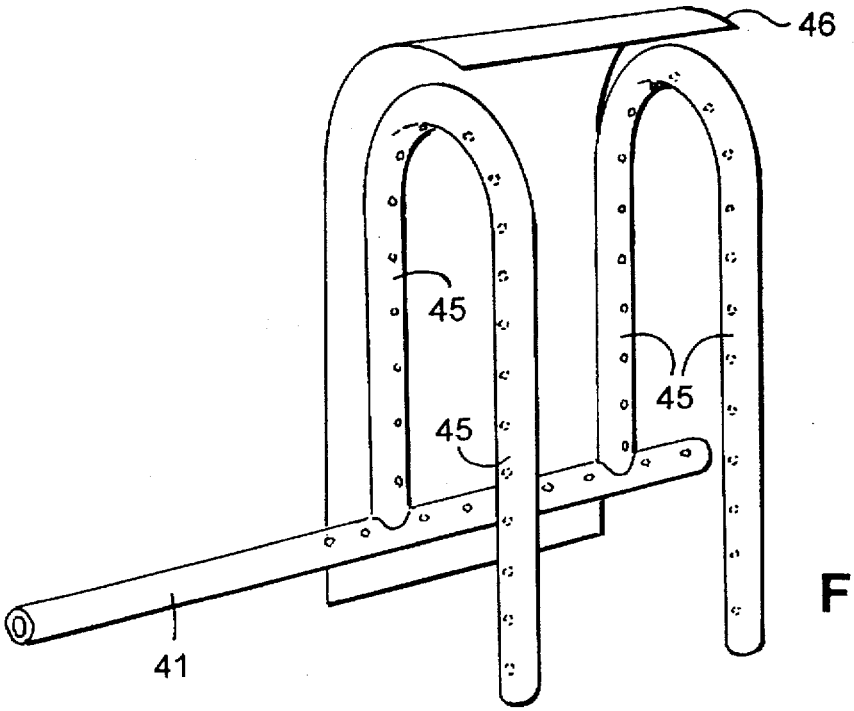

In FIG. 16 there is illustrated in schematic perspective a further embodiment wherein gas mixture ducting means 41 leads to two apertured pipe portions 45 having apertures to direct the gas mixture to envelope the pilot flame. A backing plate 46 with curved over top portion is provided to retain the gas mixture around the flame and/or to economise on use of the mixture with the devices of FIGS. 14 to 16 location means therefor will normally be provided on the gas appliance.

In its broadest aspect the method of the present invention may be performed by an operator inhaling and simply blowing air gently through a duct such as a straw or tube, to the region of the inlet 4.

Whilst an air mixture of 2% carbon dioxide in air has been mentioned, any suitable gas mixture may be provided to represent oxygen depleted air.

I claim:

1. A portable device for testing the performance of an oxygen-depletion-sensing pilot light jet comprising a gas mixture applicator means, a pressurisable vessel forming a reservoir for containing a gas mixture which has an oxygen content just below the level at which the oxygen-depletion-sensing pilot light should safely operate, a gas mixture flow control means or valve means controlling flow of said gas mixture to said applicator means; said gas mixture applicator means being connected to the reservoir by ducting for receiving said gas mixture from the reservoir and to enable supply of said gas mixture as a localised ambient environment to the pilot jet and light.

2. A device as claimed in claim 1, wherein said applicator means is selected from the group comprising:

in a first arrangement said gas mixture applicator means permitting said gas mixture to flow from said flow control means to atmosphere at ambient pressure and said applicator means including a supply duct locatable adjacent and/or over at least the air inlet aperture of an oxygen-depletion-sensing pilot light jet to supply said gas mixture thereto at ambient atmospheric pressure;

in a second arrangement said gas mixture applicator means comprising a housing locatable to surround an oxygen-depletion-sensing pilot light jet and the air inlet aperture therefor to supply said gas mixture to the air inlet aperture and to provide said gas mixture as a localised ambient environment to the pilot light; and in a third arrangement said gas mixture applicator means comprising gas mixture supply duct or pipe extending into at least one apertured supply duct portion shaped and arranged and apertured to provide a gas mixture environment surrounding said pilot light.

3. A device as claimed in claim 2, wherein in the second arrangement at least one wall portion of the housing is removable to permit location of the housing over a pilot jet.

4. A device as claimed in claim 2, wherein in the second arrangement the housing is also such as to be capable of surrounding the ignition means for a pilot light.

5. A device as claimed in claim 2, in combination with a gas appliance, in which in the third arrangement where the apertured duct provides a gas mixture wall around the pilot jet, locating means are provided on the appliance to accurately position the apertured supply duct portion.

6. A device as claimed in claim 2, wherein in the first arrangement the free end of the supply duct is so shaped as to be closely locatable against the surface surrounding the air inlet aperture of the pilot light, and wherein said free end has sealing means for sealing against said surrounding surface.

7. A device as claimed in claim 6, wherein the sealing means is provided in different replaceable forms as an adaptor to different surfaces.

8. A device as claimed in claim 2, wherein in the first arrangement attachment means are provided for releasably holding said supply duct over said air inlet aperture.

9. A device as claimed in claim 2, wherein in the first arrangement the applicator means has a main duct or chimney-like member for venting the gas mixture to atmosphere.

10. A device as claimed in claim 9, wherein the applicator means is in the form of a main tubular member with a lower-most inlet aperture in communication via the gas mixture flow control valve means of the gas mixture reservoir and having said supply duct extending therefrom.

11. A device as claimed in claim 10, wherein said supply duct extends from a lower region adjacent but spaced from the valve to enable supply at atmospheric pressure.

12. A device as claimed in claim 2, wherein in the second arrangement the applicator means is a housing which at least substantially encloses the whole of the ODS pilot light including the air inlet therefor to provide an ambient atmosphere of said gas mixture for substantially the whole of the pilot light and its flame except for an opening provided in the housing which exists to permit the pilot light to ignite the adjacent burner.

13. An improved gas appliance including an ODS pilot light jet and being adapted to be tested with a portable testing device including a gas supply pipe leading to said jet, comprising displacement-enabling-means which are provided to enable at least said jet to be displaced sufficiently to enable a gas mixture applicator housing to be located therearound.

14. An appliance according to claim 13, wherein said jet and thermocouple and ignition means are mounted on a mounting support mounted on a mounting on the appliance, and wherein the enabling means are provided to also enable the mounting support with thermocouple and ignition means, when detached from said mounting on the appliance to be sufficiently displaced.

15. An appliance according to claim 13, wherein the displacement enabling means is selected from the group comprising a displaceable joint in the supply pipe, a pivoting joint, a universal joint, a more flexible portion of the supply pipe, and a supply pipe extension means.

16. An appliance according to claim 15, wherein said displacement enabling means are supply pipe extension means.

17. An appliance as claimed in claim 16, wherein said extension means is an extra length of tube and the jet is detachable from its supply pipe and the extra length of tube connectable to the supply pipe and to the jet.

18. An appliance as claimed in claim 15, wherein said extension means comprise supply pipe longer than simply required to supply gas to said pilot jet.

19. An appliance according to claim 18, wherein said extension means is at least one loop or "pig tail" which enables supply pipe to be flexed and at least the pilot jet to be displaced sufficiently away from its mounting point on the appliance to permit the applicator housing to be located therearound.

20. An appliance as claimed in claim 18, wherein the extra length of tube is such as to maintain the requisite pressure for an accurate and representative test of the jet.

21. An appliance as claimed in claim 13, wherein said applicator housing is capable of free standing and a mounting means for at least said jet is provided in the housing.

22. An appliance as claimed in at least claim 13, wherein an exhaust duct is provided in an upper region of the housing.

23. A combination of a device and an appliance as claimed in claim 13.

24. A portable device for testing an ODS pilot light jet comprises a portable housing in which a jet is locatable in a condition selected from the group comprising dismounted from the gas appliance with extension means supplying gas from the appliance or having a separate gas supply connection, detached from the main body of the appliance while retaining its gas supply connection therewith and optionally via extension means such as at least one supply pipe loop, and in situ on the appliance, with said portable housing being closable or sealable at least around the gas supply pipe of the jet or extension means of the gas supply pipe so as to provide a closed and sealed space in which the pilot jet light may burn until extinguished by the combustion products of the flame.

25. A device according to claim 24, wherein a suitable flame viewing means or flame detecting means is provided so that the time of extinction of the flame after closing the housing can be measured to determine the operating condition of the ODS jet.

26. A device according to claim 24, wherein said portable housing is provided to contain at least the pilot jet when removed from the appliance, said housing having a mounting bracket for the jet or a connection means for the mounting bracket of the appliance and jet together with the thermocouple and spark ignition means, and a back wall or plate of the housing, with slot for replicating the burner ignition slot, and said back wall presenting the same back plate and ignition slot relationship as exists on the appliance from which the jet has been detached.

27. A portable device for testing the performance of an oxygen depletion sensing pilot light jet comprises a cover means or hood for covering at least the pilot light with said cover means having an inspection window or viewing gap for viewing the pilot flame, a gas mixture reservoir and gas mixture flow control means; said cover being shaped to ensure when mixture flows the ODS pilot jet is in an ambient gas mixture atmosphere to test the jet.

28. A method of testing in situ the performance of an oxygen depletion sensing pilot light jet of a gas fire or other gas appliance, comprising the testing steps applying an oxygen depleted gas mixture to at least the air inlet of said pilot jet when the pilot light is lit, and determining whether the pilot flame ceases to act upon the thermocouple of the appliance so as to cut off the main gas supply.

29. A method according to claim 28 wherein the gas mixture is applied by applying such via a surrounding housing, or via an apertured mixture ducting means that has apertures which form a surrounding atmosphere of said mixture, or via a front cover.

30. A method as claimed in claim 29, wherein the gas mixture is applied by applying a portable housing around the pilot jet so it is housed within a space, and determining when or whether the ignited pilot light ceases to burn because of combustion products of the flame means in the region of the pilot jet.

31. A method as claimed in claim 29, wherein the oxygen depleted mixture is applied by an operator inhaling and blowing air gently through a duct to the region of the inlet.

* * * * *